US006463628B1

(12) United States Patent
Yeh

(10) Patent No.: US 6,463,628 B1
(45) Date of Patent: Oct. 15, 2002

(54) LAMINATED-GLASS DOOR HANDLE ASSEMBLY

(76) Inventor: Hua-Tung Yeh, P.O. Box 90, Tainan City (TW)

( * ) Notice: Subject to any disclaimer, the term of this patent is extended or adjusted under 35 U.S.C. 154(b) by 0 days.

(21) Appl. No.: 09/895,188

(22) Filed: Jul. 2, 2001

(51) Int. Cl.[7] ..... E05B 1/00

(52) U.S. Cl. ..... 16/412; 16/DIG. 41; 292/DIG. 53

(58) Field of Search ..... 292/DIG. 53, DIG. 63; 16/403, 412, DIG. 41, 413, 402; 4/596, 599, 600, 610

(56) References Cited

U.S. PATENT DOCUMENTS 1,145,471 A * 7/1915 Dobrick ..... 16/492
3,995,349 A * 12/1976 Roberts et al. ..... 16/125
4,471,984 A * 9/1984 Bellantuono ..... 292/350
4,569,547 A * 2/1986 Fayerman et al. ..... 292/347
4,641,462 A * 2/1987 Markus ..... 16/110 R
4,895,399 A * 1/1990 Horgan, Jr. ..... 292/92
4,912,809 A * 4/1990 Scheuer ..... 16/114 R
D340,179 S * 10/1993 Mirick et al. ..... D8/301
5,700,105 A * 12/1997 Salice ..... 16/382
5,740,587 A * 4/1998 Onai et al. ..... 16/111 R

FOREIGN PATENT DOCUMENTS

JP 04250280 A * 9/1992 ..... E05B/1/00

* cited by examiner

*Primary Examiner*—Thomas B. Will
*Assistant Examiner*—Alexandra K. Pechhold

(57) ABSTRACT

A laminated-glass door handle assembly includes a first handle and a second handle oppositely fastened to a glass door at both sides by at least one coupling device. Moreover, the first handle and the second handle both made of laminated glass and formed as a sandwich of 2 sheets of glass bonded to a tinted interlayer have excellent strength to resist impact and can be made with different colors and patterns in the tinted interlayer to meet a whole design of different buildings.

2 Claims, 5 Drawing Sheets

LAMINATED-GLASS DOOR HANDLE ASSEMBLY

BACKGROUND OF THE INVENTION

1. Field of the Invention

This invention relates to a laminated-glass door handle assembly, particularly to one including a first handle and a second handle both made of laminated glass, oppositely fastened to a glass door at both sides by at least one coupling device, provided with different shapes and colors to meet a whole design of different buildings, and having excellent strength to resist shock and impact.

2. Description of the Prior Art

A known conventional door handle assembly, as shown in FIGS. 1 and 2, includes an inside handle 11 and an outside handle 12 made of metal round tubes with bent configuration and oppositely fastened to a glass door 10. The glass door 10 has two through holes 100 respectively fastened with two upper openings and two lower openings of the inside handle 11 and the outside handle 12. In assembling, firstly extend an adjusting screw 17 through a central hole 160 of a stop block 16, a central hole 150 of a first washer 15, the upper through hole 100 of the glass door 10, a central hole 140 of a second washer 14 and then screw the adjusting screw 17 in a threaded hole 130 of a stationery seat 13 secured in an upper opening of the inside handle 11, by which the upper opening of the inside handle 11 can be fastened to the glass door 10 at one side. Secondly, cover an upper opening of the outside handle 12 to the stop block 16, align a through hole 120 extending through two sidewalls of the upper opening of the outside handle 12 with two threaded holes 161 oppositely disposed at two sidewalls of the stop block 16, and then extend two locking screws 18 respectively into two ends of the through hole 120 of the upper opening of the outside handle 12 to be firmly screwed in the two threaded hole 161 of the stop block 16, by which the two upper openings of the inside handle 11 and the outside handle 12 can be fastened to the glass door 10. The two lower openings of the inside handle 11 and the outside handle 12 can be fastened to the glass door 10 with the same steps. However, such kind of known conventional door handle assembly has the following disadvantages:

1. The inside handle 11 and the outside handle 12 made of metal round tubes with bent configuration only have simple shapes and are hard to make complicated designs in their appearances.
2. The inside handle 11 and the outside handle 12 made of metal round tubes with bent configuration are easy to be deformed under impact and become ugly.
3. The inside handle 11 and the outside handle 12 may be loosened and become unsteady after a period of use.
4. It is troublesome and time-consuming in the alignment of the two threaded holes 161 of the stop block 16 with two ends of the through hole 120 of the outside handle 12 for being screwed with the two locking screws 18.
5. "Push" and "Pull" signs generally attached on both surfaces of the glass door 10 not only influence the beauty of the glass door 10, but also can be easily separated from the glass door 10.

SUMMARY OF THE INVENTION

The main purpose of the invention is to offer a laminated-glass door handle assembly, particularly to one including a first handle and a second handle both made of laminated glass, oppositely fastened to a glass door at both sides by at least one coupling device, provided with different shapes and colors to meet a whole design of different buildings, and having excellent strength to resist shock and impact.

The main feature of the invention is to provide a laminated-glass door handle assembly including a first handle and a second handle both made of laminated glass and oppositely fastened to a glass door at both sides by at least one coupling device;

the glass door having at least one through hole for being fastened by the coupling device;

the coupling device joining the first handle, the glass door and the second handle together, and including a first socket, a second socket, a first lock screw, a second lock screw, a locating ring, a lock ring, a first washer, a second washer and a connection bolt;

the first socket provided with a first opening disposed at its front end, a first chamber disposed at its rear end and communicating with the first opening, a first through hole disposed at its back wall and communicating with the first chamber, and a plurality of threaded holes arranged on its outer wall and penetrating through the first chamber and each screwed with a set screw;

the second socket provided with a second opening disposed at its front end and having an internal thread formed in an inner wall of the second opening, a second chamber disposed at its rear end and communicating with the second opening, and a second through hole disposed at its back wall and communicating with the second chamber;

the first lock screw disposed in the first chamber and extending through the first through hole for screwing the first socket to the first handle, and the second lock screw disposed in the second chamber and extending through the second through hole for screwing the second socket to the second handle;

the lock ring having a threaded hole formed in its center, a plurality of through holes arranged on its side wall, and an external thread formed on its outer wall for being screwed with the internal thread of the second opening of the second socket;

the locating ring having a through hole in its center and capable of being accommodated in the first opening of the first socket;

the first washer having a central hole and disposed between the first socket and the glass door, and the second washer having a central hole and disposed between the second socket and the glass door; and, the connection bolt having a body, a head with an inclined wall, and a collar flange formed between the head and the body, the head with the inclined wall capable of being accommodated in the first chamber of the first socket, the body capable of orderly extending through the central hole of the locating ring, the central hole of the first washer, the through hole of the glass door, the central hole of the second washer, and being screwed with the threaded hole of the lock ring.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
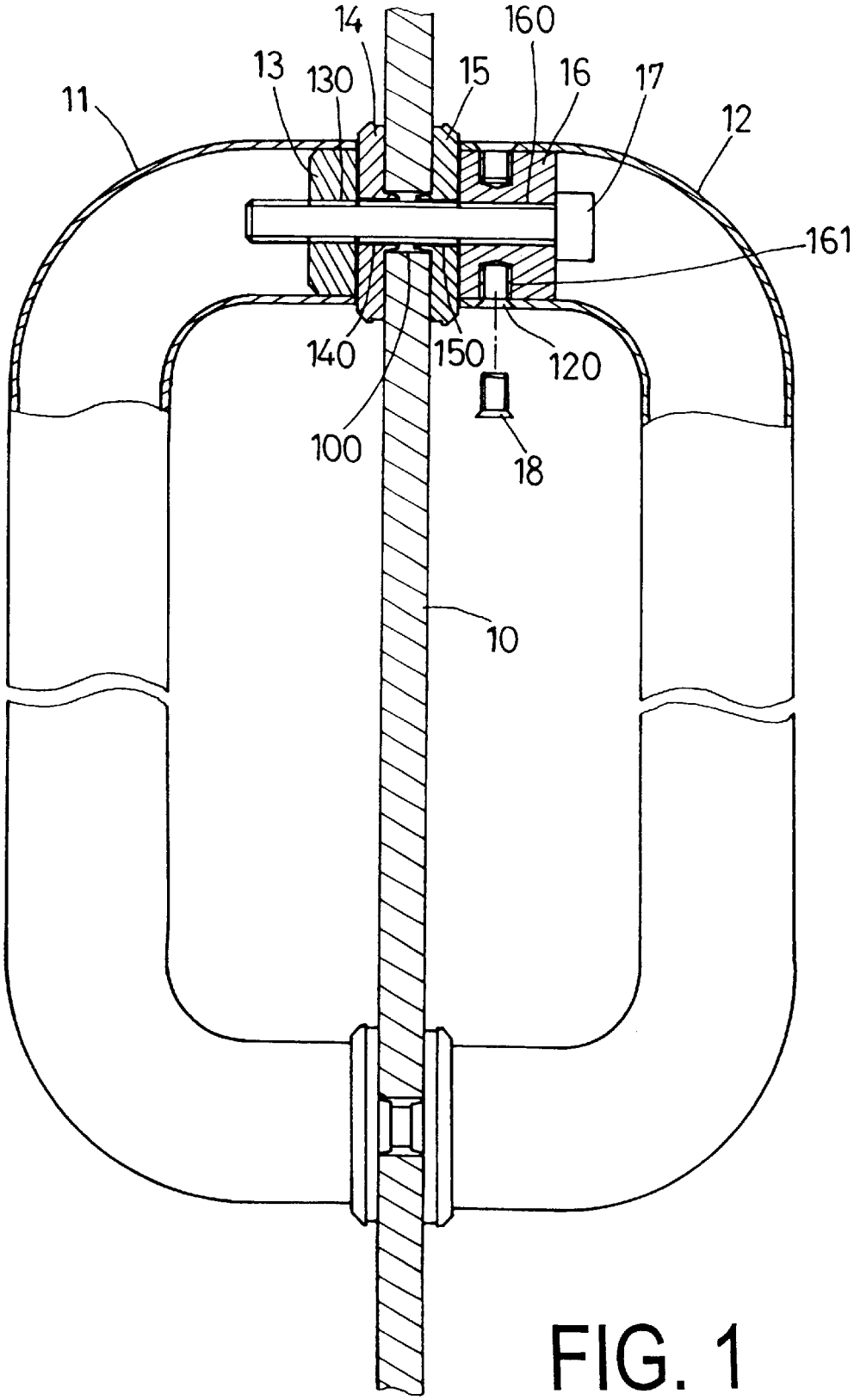
FIG. 1 (PRIOR ART)
FIG. 1 is a cross-sectional view of showing an assemblage of known conventional door handles.
Figure 2:
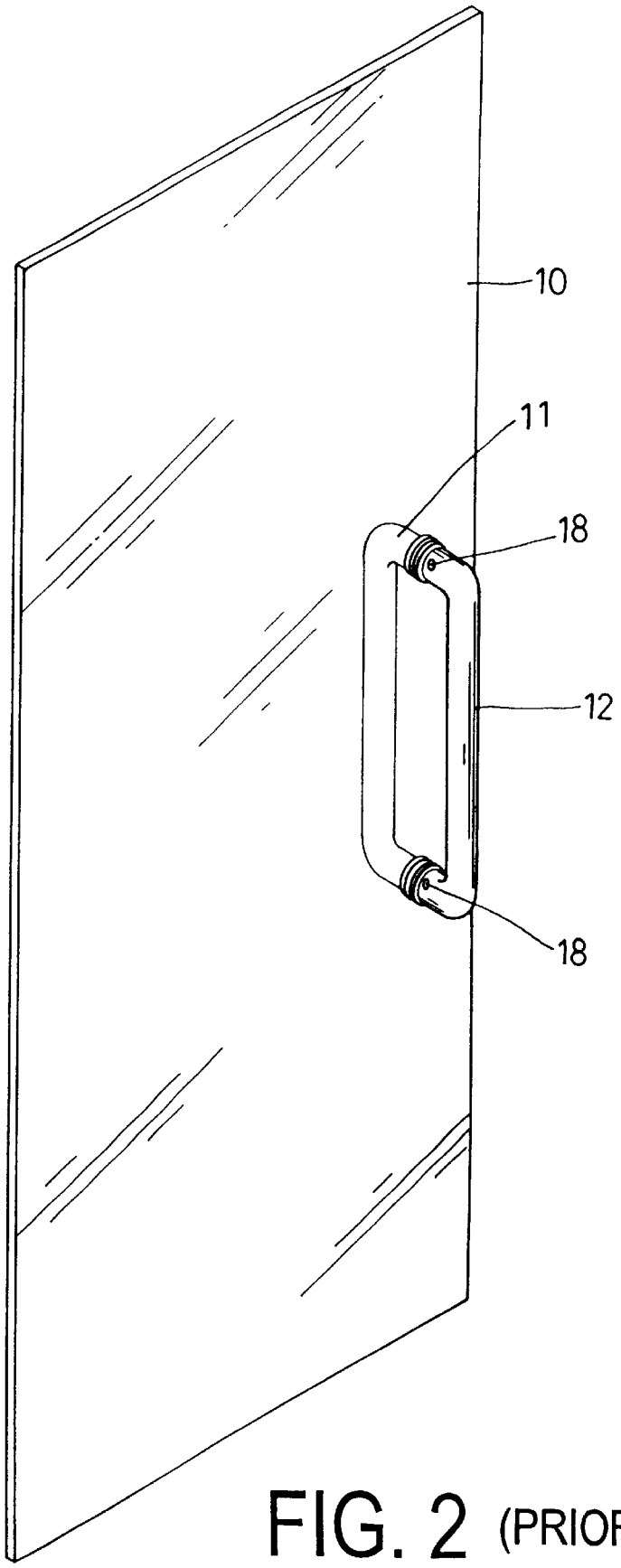
FIG. 2 (PRIOR ART)
FIG. 2 is a schematic view of the known conventional door handles.
Figure 3:
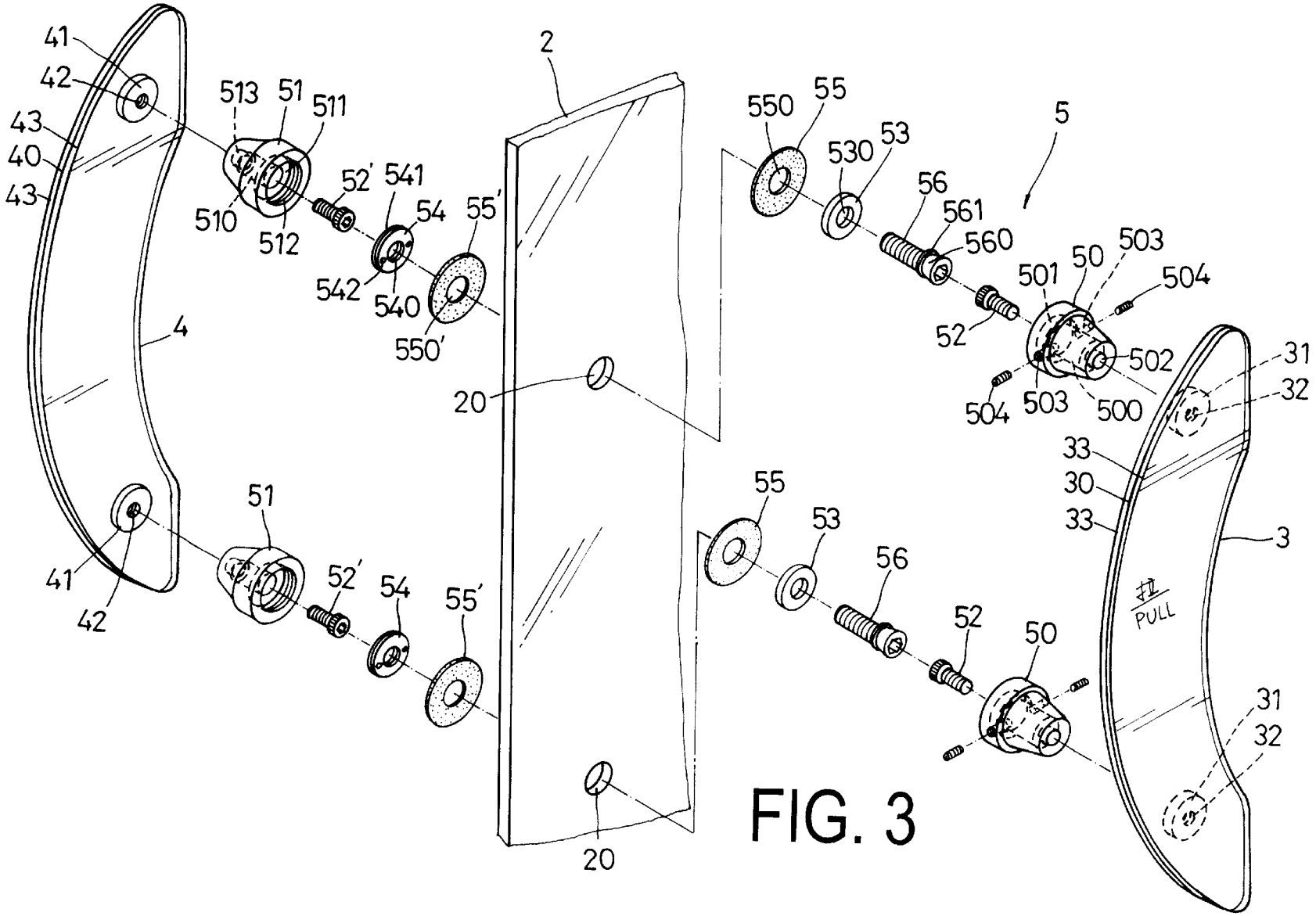
FIG. 3 is an exploded perspective view of a laminated-glass door handle assembly in the present invention.

A preferred embodiment of the laminated-glass door handle assembly in the present invention, as shown in FIG. 3, includes a first handle 3 and a second handle 4 oppositely fastened to a glass door 2 at both sides by two coupling devices 5.

The first handle 3 and the second handle 4 both are made of laminated glass. The first handle 3 is formed as a sandwich of 2 sheets of glass 33 bonded to a tinted interlayer 30; the second handle 4 is formed as a sandwich of 2 sheets of glass 43 bonded to a tinted interlayer 40. Two stationery seats 31 each with a threaded hole 32 are disposed at a side of the first handle 3 opposite to a side of the second handle 4 having two stationery seats 41 each with a threaded hole 42.

Each of the coupling devices 5 used to join said first handle 3, said glass door 2 and said second handle 4 together includes a first socket 50, a second socket 51, a first lock screw 52, a second lock screw 52', a locating ring 53, a lock ring 54, a first washer 55, a second washer 55' and a connection bolt 56. The first socket 50 is,fastened in each of the two stationery seats 31 of the first handle 3 opposite to the second socket 51 fastened in each of the two stationery seats 41 of the second handle 4.

The first socket 50 is provided with a first opening 501 disposed at its front end, a first chamber 500 disposed at its rear end and communicating with the first opening 501, a first through hole 502 disposed at its back wall and communicating with the first chamber 500, and two threaded holes 503 arranged on its outer wall and penetrating through the first chamber 500 and each screwed with a set screw 504.

The second socket 51 is provided with a second opening 511 disposed at its front end and having an internal thread 512 formed in an inner wall of the second opening 511, a second chamber 510 disposed at its rear end and communicating with the second opening 511, and a second through hole 513 disposed at its back wall and communicating with the second chamber 510.

The first lock screw 52 is disposed in the first chamber 500 and extending through the first through hole 502 for screwing the first socket 50 to the first handle 3, and the second lock screw 52' is disposed in the second chamber 510 and extending through the second through hole 513 for screwing the second socket 51 to the second handle 4.

The lock ring 54 has a threaded hole 540 formed in its center, two through holes 542 arranged on its side wall, and an external thread 541 formed on its outer wall for being screwed with the internal thread 512 of the second opening 511 of the second socket 51.

The locating ring 53 has a through hole 530 in its center and can be accommodated in the first opening 501 of the first socket 50.

The first washer 55 has a central hole 550 and is disposed between the first socket 50 and the glass door 2, and the second washer 55' has a central hole 550' and is disposed between the second socket 51 and the glass door 2.

The connection bolt 56 is provided with a body, a head with an inclined wall 560, and a collar flange 561 formed between the head and the body. The head with the inclined wall 560 can be accommodated in the first chamber 500 of the first socket 50. The body is capable of orderly extending through the central hole 530 of the locating ring 53, the central hole 550 of the first washer 55, one of the two through holes 20 of the glass door 2, the central hole 550' of the second washer 55', and being screwed with the threaded hole 540 of the lock ring 54.

Figure 4:
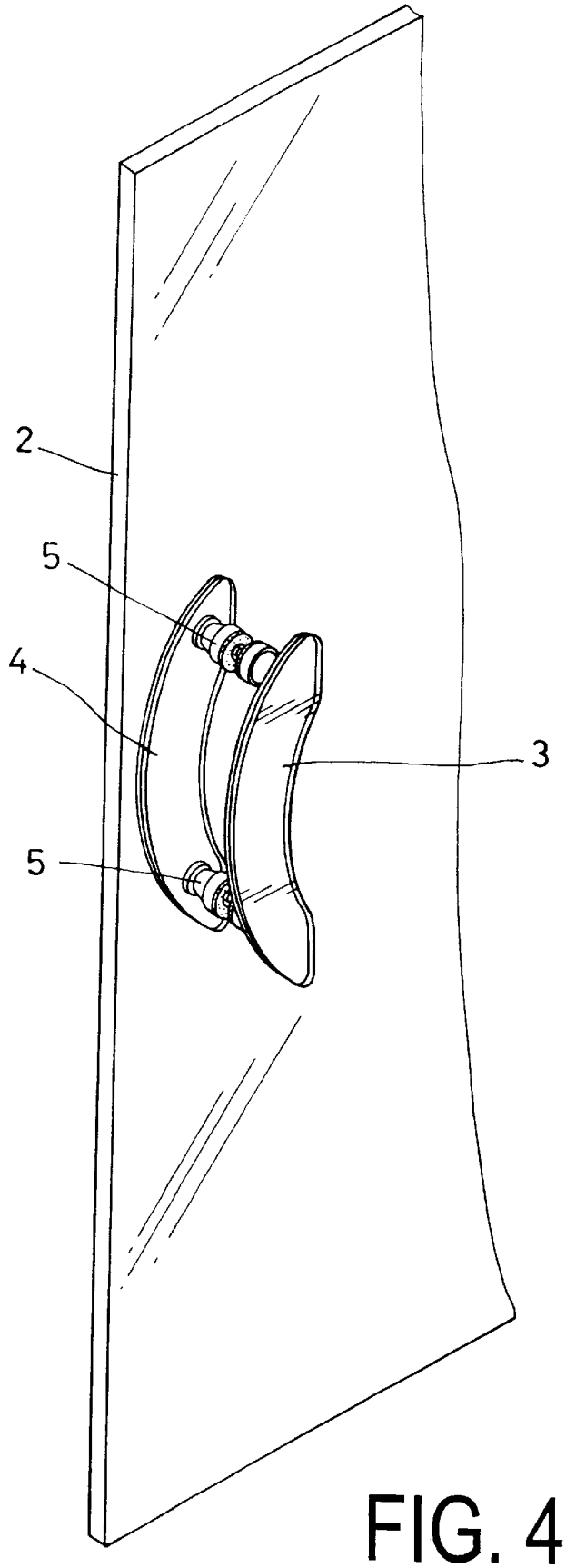
FIG. 4 is a schematic view of showing an assemblage of the laminated-glass door handle assembly in the present invention; and, FIG. 5 is a cross-sectional view of showing the assemblage of the laminated-glass door handle assembly in the present invention.
Figure 5:
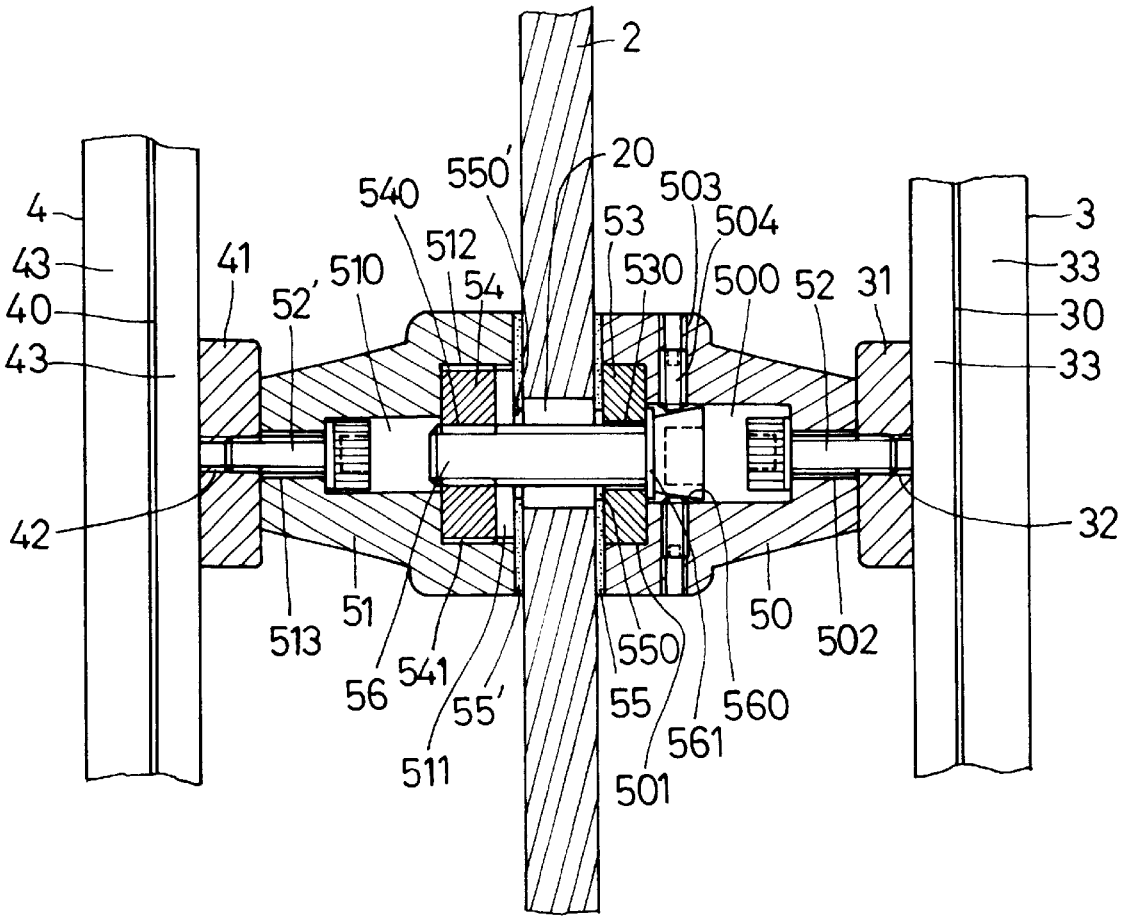

In assembling, referring to FIGS. 3, 4 and 5, firstly extend the second lock screw 52' through the second through hole 513 to screw the second socket 51 to one of the two stationery seats 41 of the second handle 4, and screw the lock ring 54 with the internal thread 512 of the second opening 511 of the second socket 51. Secondly, place the second washer 55' between the second socket 51 and the glass door 2, and attach the second socket 51 and the second washer 55' at one side of the glass door 2. Thirdly, extend the body of the connection bolt 56 from the opposite side of the glass door 2, through the central hole 530 of the locating ring 3, the central hole 550 of the first washer 55, the same hole 20 of the glass door 2, the central hole 550' of the second washer 55', and then screw the body of the connection bolt 56 with the threaded hole 540 of the lock ring 54, by which the connection bolt 56 is capable of fastening the second handle 4 at the side of the glass door 2, and fastening the locating ring 53 and the first washer 55 at the opposite side of the glass door 2. Fourthly, extend the first lock screw 52 through the first through hole 502 to screw the first socket 50 to each of the two stationery seats 31 of the first handle 3 correspondingly opposite to the stationery seat 41. Fifthly, attach the first opening 501 of the first socket 50 to the first washer 55 so that the head with the inclined wall 560 of the connection bolt 56 can be accommodated in the first chamber 500 of the first socket 50 and the locating ring 53 can be accommodated in the first opening 501 of the first socket 50. Sixthly, inwardly screw the two set screws 504 into the two threaded holes 503 of the first chamber 500 until their ends touch against the inclined wall 560 of the head of the connection bolt 56 so that the head with the inclined wall 560 of the connection bolt 56 is fastened in the first chamber 500 of the first socket 50, by which the first handle 3 and the second handle 4 can be fastened to the glass door 2 at both sides, as shown in FIG. 4.

The invention has the following advantages, as can be understood from the aforesaid description.

1. The first handle 3 and the second handle 4 made of laminated glass both have excellent strength to resist impact.
2. The first handle 3 and the second handle 4 made of laminated glass can be made with different colors and patterns in the tinted interlayer 30 or 40 to meet a whole design of different buildings.
3. The first handle 3 and the second handle 4 made of laminated glass can be printed with the words "PUSH" or "PULL" directly in the tinted interlayer 30 or 40 without additional "PUSH" or "PULL" signs attached on the glass door 2 to destroy the beauty of the glass door 2.
4. The first handle 3 and the second handle 4 can be changed with different designs in configuration for various uses.
5. The first handle 3 and the second handle 4 can be firmly fastened to the glass door 2 by inwardly screwing the two set screws 504 into the two threaded holes 503 of the first chamber 500 until their ends touch against the inclined wall 560 of the head of the connection bolt 56 so that the head with the inclined wall 560 of the connection bolt 56 is fastened in the first chamber 500 of the first socket 50, as shown in FIG. 5, without the slightest fear of looseness or shaking.

While the preferred embodiment of the invention has been described above, it will be recognized and understood that various modifications may be made therein and the appended claims are intended to cover all such modifications that may fall within the spirit and scope of the invention.

What is claimed is:

1. A laminated-glass door handle assembly comprising a first handle and a second handle both made of laminated glass and oppositely fastened to a glass door at both sides by at least one coupling device;

said glass door having at least one through hole for being fastened by each said coupling device;

each said coupling device joining said first handle, said glass door and said second handle together, and including a first socket, a second socket, a first lock screw, a second lock screw, a locating ring, a lock ring, a first washer, a second washer and a connection bolt;

said first socket provided with a first opening disposed at a front end, a first chamber disposed at a rear end and communicating with said first opening, a first through hole disposed at a back wall and communicating with said first chamber, and a plurality of threaded holes arranged on an outer wall and penetrating through said first chamber and each screwed with a set screw;

said second socket provided with a second opening disposed at a front end and having an internal thread formed in an inner wall of said second opening, a second chamber disposed at a rear end and communicating with said second opening, and a second through hole disposed at a back wall and communicating with said second chamber;

said first lock screw disposed in said first chamber and extending through said first through hole for screwing said first socket to said first handle, and said second lock screw disposed in said second chamber and extending through said second through hole for screwing said second socket to said second handle;

said lock ring having a threaded hole formed in the center, a plurality of through holes arranged on a side wall, and an external thread formed on an outer wall for being screwed with said internal thread of said second opening of said second socket;

said locating ring having a through hole in the center and capable of being accommodated in said first opening of said first socket;

said first washer having a central hole and disposed between said first socket and said glass door, and said second washer having a central hole and disposed between said second socket and said glass door;

said connection bolt having a body, a head with an inclined wall, and a collar flange formed between said head and said body, said head with said inclined wall capable of being accommodated in said first chamber of said first socket, said body capable of orderly extending through said central hole of said locating ring, said central hole of said first washer, said through hole of said glass door, said central hole of said second washer, and being screwed with said threaded hole of said lock ring;

whereby said first handle and said second handle can be oppositely fastened to said glass door by said coupling device with excellent strength as well as steadiness and without the slightest fear of looseness or shaking.

2. A laminated-glass door. handle assembly as claimed in claim 1, wherein at least one stationery seat each with a threaded hole can be disposed at two opposite inner sides of said first handle and said second handle.

* * * * *